US010463573B2

(12) United States Patent
Zhao et al.

(10) Patent No.: US 10,463,573 B2
(45) Date of Patent: Nov. 5, 2019

(54) SEALED FLUID TRANSFER DEVICE AND SEALED FLUID TRANSFER METHOD

(71) Applicant: Shinva Ande Healthcare Apparatus Co., Ltd, Zibo, Shandong (CN)

(72) Inventors: Jilong Zhao, Shandong (CN); Qiang Wang, Shandong (CN); Shouyu Sun, Shandong (CN)

(73) Assignee: Shinva Ande Healthcare Apparatus Co., Ltd, Zibo, Shandong (CN)

( * ) Notice: Subject to any disclaimer, the term of this patent is extended or adjusted under 35 U.S.C. 154(b) by 95 days.

(21) Appl. No.: 15/763,444

(22) PCT Filed: Jul. 17, 2017

(86) PCT No.: PCT/CN2017/093142

§ 371 (c)(1),
(2) Date: Mar. 27, 2018

(87) PCT Pub. No.: WO2018/024092

PCT Pub. Date: Feb. 8, 2018

(65) Prior Publication Data

US 2018/0271749 A1 Sep. 27, 2018

(30) Foreign Application Priority Data

Aug. 3, 2016 (CN) ..... 2016 1 0630585
Aug. 3, 2016 (CN) ..... 2016 2 0840014

(51) Int. Cl.
*A61J 1/20* (2006.01)
*B01F 5/00* (2006.01)
(Continued)

(52) U.S. Cl.
CPC ..... *A61J 1/2089* (2013.01); *B01F 3/12* (2013.01); *B01F 5/00* (2013.01); *B01F 15/0203* (2013.01);
(Continued)

(58) Field of Classification Search
CPC .. A61J 1/1406; A61J 1/20; A61J 1/201; A61J 1/2013; A61J 1/2065; A61J 1/2089;
(Continued)

(56) References Cited

U.S. PATENT DOCUMENTS 8,196,614 B2 * 6/2012 Kriheli ..... A61J 1/2096 141/5
8,540,691 B2 * 9/2013 Hasegawa ..... A61J 1/2096 141/329

(Continued)

*Primary Examiner* — Matthew W Jellett

(57) ABSTRACT

A sealed fluid transfer device and a sealed fluid transfer method includes a first container puncture apparatus, a second container puncture apparatus and a fluid transfer apparatus, wherein the fluid transfer apparatus includes a first container puncture adapter, a second container puncture adapter and a pressure supply unit; the first container puncture adapter includes a sealing element fixed seat, a guided outer casing, a pipeline fixed seat, a first fluid pipeline and a second fluid pipeline; when the sealing element fixed seat is connected with the first container puncture apparatus, a first sealing element is firstly tightly connected with a second sealing element, the first fluid pipeline and the second fluid pipeline respectively pass through the two sealing elements and then communicate with the first container; after being firstly used, the first fluid pipeline and the second fluid pipeline are always in no contact with the exterior.

17 Claims, 4 Drawing Sheets

(51) Int. Cl.
*B01F 3/12* (2006.01)
*B01F 15/02* (2006.01)
*A61J 1/14* (2006.01)

(52) U.S. Cl.
CPC ..... *B01F 15/0238* (2013.01); *A61J 1/1406* (2013.01); *A61J 1/2013* (2015.05); *A61J 1/2065* (2015.05); *B01F 2215/0032* (2013.01)

(58) Field of Classification Search
CPC ..... A61M 2039/1072; B01F 15/0238; B01F 2215/0032
USPC ..... 141/330
See application file for complete search history.

(56) References Cited

U.S. PATENT DOCUMENTS

| | | | | |
|---|---|---|---|---|
| 8,545,476 | B2 * | 10/2013 | Ariagno | A61J 1/2089 604/414 |
| 9,402,784 | B2 * | 8/2016 | Simpson | A61J 1/2089 |
| 10,357,430 | B2 * | 7/2019 | Kriheli | A61J 1/14 |
| 2011/0087164 | A1 * | 4/2011 | Mosler | A61J 1/2089 604/87 |
| 2011/0178493 | A1 * | 7/2011 | Okiyama | A61J 1/2089 604/406 |
| 2016/0256632 | A1 * | 9/2016 | Fangrow | A61J 1/2096 |
| 2017/0027820 | A1 * | 2/2017 | Okiyama | A61J 1/201 |

* cited by examiner

SEALED FLUID TRANSFER DEVICE AND SEALED FLUID TRANSFER METHOD

CROSS REFERENCE OF RELATED APPLICATION

This is a U.S. National Stage under 35 U.S.C 371 of the International Application PCT/CN2017/093142, filed Jul. 17, 2017, which claims priority under 35 U.S.C. 119(a-d) to CN 201610630585.4, filed Aug. 3, 2016, and CN 201620840014.9, filed Aug. 3, 2016.

BACKGROUND OF THE PRESENT INVENTION

Field of Invention

The present invention relates to a field of fluid preparation, and more particularly to a sealed fluid transfer device and a sealed fluid transfer method.

Description of Related Arts

Pharmaceutical personnel involved in the preparation and management of hazardous fluids are easily hurt by hazardous fluids and fluid vapors exposed to the atmosphere which can diffuse into the surrounding environment. Here, "hazardous fluids" refers to any injectable materials. Contacting with these materials or the vapors of the materials can cause great harm to the health. Illustrative and non-limiting examples of such fluids include, but are not limited to, cytotoxics, antivirals, chemotherapy fluids, antibiotics and radiopharmaceuticals such as herceptin, cisplatinum, fluorouracil, Leucovorin, taxol, metatroxat, gemzar for injection, cyclophosphamide, cytoxan and cyclophosphamide neosar, or liquid, solid or gaseous combinations of the fluids listed above.

Among them, hazardous fluids in the form of liquid or powder are contained in a vial (first container) and are usually prepared in a separate room by pharmaceutical personnel provided with protective clothing, masks and laminar safety cabinets. The pharmaceutical personnel utilize a syringe provided with an intubation, that is, a hollow syringe needle, to deliver the hazardous fluids from the vial (first container), so that the hazardous fluids are added to the corresponding solution.

Since the hazardous fluids are toxic, direct physical contact with the hazardous fluids or even a small amount of hazardous fluid vapors exposed to the air can cause the damage to the human body and increase the risk of physical illnesses, such as skin cancer, leukemia, liver damage, deformity, abortion and premature delivery. In traditional hazardous fluid dispensing process, some positions which easily cause the exposure of the hazardous fluids to the air comprise containers for the hazardous fluids (such as vials, bottles, syringes and intravenous injection bags). After these positions go through the over pressure, the hazardous fluids are easily exposed to the air, so that the air is polluted. Residual fluid solution on the needle tip, the vial or intravenous bag seal may also result in the exposure of the hazardous fluids. Therefore, there is a need to provide a fluid dispensing device which is able to avoid the exposure of the hazardous fluids to the air or the hazardous fluids in direct contact with the human body during the hazardous fluid dispensing process, so that the sealed fluid dispensing process is completed inside the dispensing device.

SUMMARY OF THE PRESENT INVENTION

An object of the present invention is to provide a sealed fluid transfer device and a sealed fluid transfer method in a closed environment, which are able to achieve the fluid internal conversion, so as to solve the problems in the prior art, to complete the internal preparation of hazardous fluids in the closed environment, thus avoiding the hazardous fluids in direct contact with the air or the human body, and meanwhile preventing medical staff from being hurt by acupuncture.

In order to achieve the above object, the present invention provides technical solutions as follows. The present invention provides a sealed fluid transfer device, which comprises a first container puncture apparatus, a second container puncture apparatus and a fluid transfer apparatus, wherein the fluid transfer apparatus comprises a first container puncture adapter, a second container puncture adapter and a pressure supply unit; the first container puncture adapter comprises a sealing element fixed seat, a guided outer casing, a first fluid pipeline and a second fluid pipeline; a first sealing element is installed in the sealing element fixed seat; the guided outer casing is located outside the sealing element fixed seat; a pipeline fixed seat is located at a lower portion of the guided outer casing; both the first fluid pipeline and the second fluid pipeline are located on the pipeline fixed seat; a tail portion of the first fluid pipeline is communicated with one end of a third fluid pipeline, the other end of the third fluid pipeline is communicated with the pressure supply unit; a tail portion of the second fluid pipeline is communicated with the second container puncture adapter through a fourth fluid pipeline; the second container puncture adapter is communicated with the second container puncture apparatus;

one end of the first container puncture apparatus is located at a mouth portion of a first container, a second sealing element is located at the other end of the first container puncture apparatus;

when a distance between a bottom surface of the sealing element fixed seat and a bottom surface of the guided outer casing is defined as a first distance, both a fluid outlet of the first fluid pipeline and a fluid outlet of the second fluid pipeline are located outside the first sealing element; when the distance between the bottom surface of the sealing element fixed seat and the bottom surface of the guided outer casing is defined as a second distance, both the fluid outlet of the first fluid pipeline and the fluid outlet of the second fluid pipeline are located inside the first sealing element; when the distance between the bottom surface of the sealing element fixed seat and the bottom surface of the guided outer casing is defined as a third distance, both the fluid outlet of the first fluid pipeline and the fluid outlet of the second fluid pipeline pass through the second sealing element and then enter the first container puncture apparatus; the first container puncture adapter is communicated with the first container puncture apparatus.

Preferably, both the fluid outlet of the first fluid pipeline and the fluid outlet of the second fluid pipeline are exposed outside the pipeline fixed seat.

Preferably, the sealing element fixed seat has a guided hole, both the second fluid pipeline and the first fluid pipeline pass through the guided hole and then enter the sealing element fixed seat.

Preferably, both a fifth fluid pipeline and a sixth fluid pipeline are located in the first container puncture apparatus; one end of both the fifth fluid pipeline and the sixth fluid pipeline extends into the first container, the other end thereof extends to the second sealing element.

Preferably, the guided outer casing has a limit hole and a limit arm; a root portion of the limit arm is fixedly located at a bottom of the limit hole and an end portion of the limit arm is dangling; a first protuberance is located at an inner side of the end portion of the limit arm, a second protuberance is located at a terminal of the first container puncture apparatus, the terminal of the first container puncture apparatus extends into the sealing element fixed seat, the first protuberance contacts with the second protuberance, and the second protuberance presses the first protuberance towards an external side of the guided outer casing.

Preferably, the sealing element fixed seat comprises the bottom surface of the sealing element fixed seat and a side wall thereof, wherein a third concave part, which matches with the first protuberance, is provided on the side wall of the sealing element fixed seat; the third concave part has a first plane facing towards a bottom on the side wall of the sealing element fixed seat; the first protuberance has a second plane opposite to the first plane; when the first protuberance is not pressed towards the external side of the guided outer casing, a projection of the first plane and a projection of the second plane have overlapping regions.

Preferably, the pressure supply unit is adapted for providing a required positive or negative pressure during an operation of the sealed fluid transfer device.

Preferably, an upper limit bayonet and a lower limit bayonet are located on the side wall of the sealing element fixed seat.

Preferably, when the distance between the bottom surface of the sealing element fixed seat and the bottom surface of the guided outer casing is defined as the first distance, the upper limit bayonet and the lower limit bayonet respectively contact with an upper end surface of the guided outer casing and an upper end surface of the limit hole, so as to respectively limit the sealing element fixed seat to move upwardly and downwardly relatively to the guided outer casing.

Preferably, when the distance between the bottom surface of the sealing element fixed seat and the bottom surface of the guided outer casing is defined as the second distance, the upper limit bayonet contacts with an upper end surface of the limit hole, both the fluid outlet of the first fluid pipeline and the fluid outlet of the second fluid pipeline are located inside the first sealing element.

Preferably, the guided outer casing comprises a first concave part, the side wall of the sealing element fixed seat has a moving element mounting hole, a moving element is located in the moving element mounting hole, the other end of the first container puncture apparatus comprises a second concave part.

Preferably, a moving element sliding groove is located below the first concave part.

Preferably, when the distance between the bottom surface of the sealing element fixed seat and the bottom surface of the guided outer casing is defined as the third distance, the moving element locks the first container puncture apparatus.

Preferably, an amount of the second fluid pipeline is at least one, and an amount of the first fluid pipeline is at least one.

Preferably, the guided outer casing has an installation hole for the pipeline fixed seat at the lower portion of the guided outer casing, or the guided outer casing and the pipeline fixed seat are integrally formed.

Preferably, both the first fluid pipeline and the second fluid pipeline are installed to the pipeline fixed seat, or the first fluid pipeline, the second fluid pipeline and the pipeline fixed seat are integrally formed.

Also, the present invention provides a sealed fluid transfer method, which comprises steps of: connecting a first container with a first container puncture adapter of a fluid transfer apparatus through a first container puncture apparatus; connecting a second container with a second container puncture adapter of the fluid transfer apparatus through a second container puncture apparatus; connecting the first container puncture adapter with the second container puncture adapter through conduits; and connecting the first container puncture adapter with a pressure supply unit; wherein:

when the first container is filled with liquid, the liquid in the first container is away from a mouth position of the first container under an effect of gravity, and meanwhile, the liquid in the second container is away from a mouth position of the second container under the effect of gravity; at this time, the pressure supply unit provides a negative pressure, gas in the second container is transferred into the first container through the second container puncture apparatus, the fluid transfer apparatus and the first container puncture apparatus, and meanwhile, gas in the first container enters the pressure supply unit, the liquid in the second container enter the first container under an action of the negative pressure to form a mixed solution; at this time, the first container is inverted to move the mixed solution in the first container to the mouth position of the first container under the effect of gravity, the pressure supply unit provides a positive pressure, so that the mixed solution in the first container passes through the first container puncture apparatus, the fluid transfer apparatus and the second container puncture apparatus and reaches the second container, thus achieving sealed liquid transfer;

when the first container contains solid powders, the solid powders in the first container are away from the mouth position of the first container under the effect of gravity, and meanwhile, the liquid in the second container is away from the mouth position of the second container under the effect of gravity; at this time, the pressure supply unit provides the negative pressure, the gas in the first container enters the pressure supply unit, the liquid in the second container enters the first container under the action of the negative pressure; at this time, the first container is rocked to mix the powders in the first container with the liquid, the first container is inverted to move the mixed solution in the first container to the mouth position of the first container under the effect of gravity, the pressure supply unit provides the positive pressure, so that the mixed solution in the first container passes through the first container puncture apparatus, the fluid transfer apparatus and the second container puncture apparatus and reaches the second container, thus achieving sealed liquid transfer.

According to specific embodiments provided by the present invention, technical effects of the present invention are disclosed as follows.

When the first container of the sealed fluid transfer device provided by the present invention contains the liquid, the liquid in the first container is away from the mouth portion of the first container, and meanwhile, the liquid in the second container is away from the mouth portion of the second container, the pressure supply unit provides the negative pressure, the gas in the both first container and the second container is sucked out through the first fluid pipeline which is connected with the pressure supply unit; both the first container and the second container produce the negative pressure, and at this time, the second container is inverted, so that the liquid in the second container is close to the mouth portion thereof, the liquid in the second container passes through the second container puncture apparatus, the second container puncture adapter, the conduits, the fourth fluid pipeline, the second fluid pipeline and the fifth fluid pipeline in sequence, and then enters the first container to mix with the fluid in the first container for forming a mixed solution; the pressure supply unit provides the positive pressure, the gas in the pressure supply unit enters the first container, the mixed solution in the first container returns to the second container under the pressure of the gas; the above operational steps applied to the pressure supply unit are repeated, so as to sufficiently mix the fluid in the first container with the fluid in the second container. Accordingly, when the first container contains solid powers, the solid powers in the first container is away from the mouth portion of the first container, the pressure supply unit provides the negative pressure, the gas in the first container is sucked out through the first fluid pipeline which is connected with the pressure supply unit; both the first container and the second container produce the negative pressure, the liquid in the second container enters the first container under the action of the negative pressure, so as to sufficiently mix the solid powders in the first container with the fluid in the second container. Since the pressure supply unit is only communicated with the first fluid pipeline through the third fluid pipeline, and the first fluid pipeline only allows the air to enter or be discharged (or the pressure supply unit is full of air in the sealed condition, so that the liquid is unable to enter the first fluid pipeline under the action of the gas pressure), no mixed solution is able to enter the pressure supply unit, so that air pollution or injury to the human body are avoided caused by the residual mixed solution on the surface of the inner wall of the pressure supply unit, and the exposure of the residual mixed solution to air or the residual mixed solution in direct contact with the human body.

In addition, the fluid outlet of the first fluid pipeline and the fluid outlet of the second fluid pipeline are always in the closed state except for the fluid transfer work during the operation of the present invention. When the distance between the bottom surface of the sealing element fixed seat and the bottom surface of the guided outer casing is the first distance, both the fluid outlet of the first fluid pipeline and the fluid outlet of the second fluid pipeline are located outside the first sealing element; after the product has been subjected to a disinfection/sterilization procedure, when the distance between the bottom surface of the sealing element fixed seat and the bottom surface of the guided outer casing is the first distance, it is convenient for the device to be fully disinfected/sterilized, and the residual disinfection/sterilization medium is analyzed. When the distance between the bottom surface of the sealing element fixed seat and the bottom surface of the guided outer casing is the second distance, both the fluid outlet of the first fluid pipeline and the fluid outlet of the second fluid pipeline are located inside the first sealing element and completely isolated from the outside; when the distance between the bottom surface of the sealing element fixed seat and the bottom surface of the guided outer casing is the third distance, both the fluid outlet of the first fluid pipeline and the fluid outlet of the second fluid pipeline pass through the second sealing element and then enter the interior of the first container puncture apparatus, such that the first container puncture adapter is communicated with the first container puncture apparatus. Due to the limiting structure in the sealed fluid transfer device, both the fluid outlet of the first fluid pipeline and the fluid outlet of the second fluid pipeline are not exposed to the outside air after being used, that is, after the sealed fluid transfer device is used, the distance between the bottom surface of the sealing element fixed seat and the bottom surface of the guided outer casing can only be restored to the second position, so that the fluid mixed solution possibly remaining at the fluid outlet position of the second fluid pipelines is prevented from being exposed to the air to pollute the air for indirectly harm to the human body.

Further, in the present invention, the second concave part of the first container puncture apparatus matches with the moving member mounted on the sealing element fixed seat in the first container puncture adapter, so that the first container puncture apparatus and the first container puncture adapter are locked together. In the present invention, the moving member is used to lock the first container puncture apparatus; when the first container puncture apparatus is pulled outwards, due to the roll of the moving member, the operator need only overcomes less frictional resistance to separate the first container puncture apparatus from the first container puncture adapter.

BRIEF DESCRIPTION OF THE DRAWINGS

To describe the technical solutions in the embodiments of the present invention or in the prior art more clearly, the accompanying drawings required in the embodiments are briefly introduced as follows. Apparently, the accompanying drawings in the following description show merely some features of the present invention; for those skilled in the art, other drawings may also be obtained based on these drawings without creative efforts.

Figure 1:
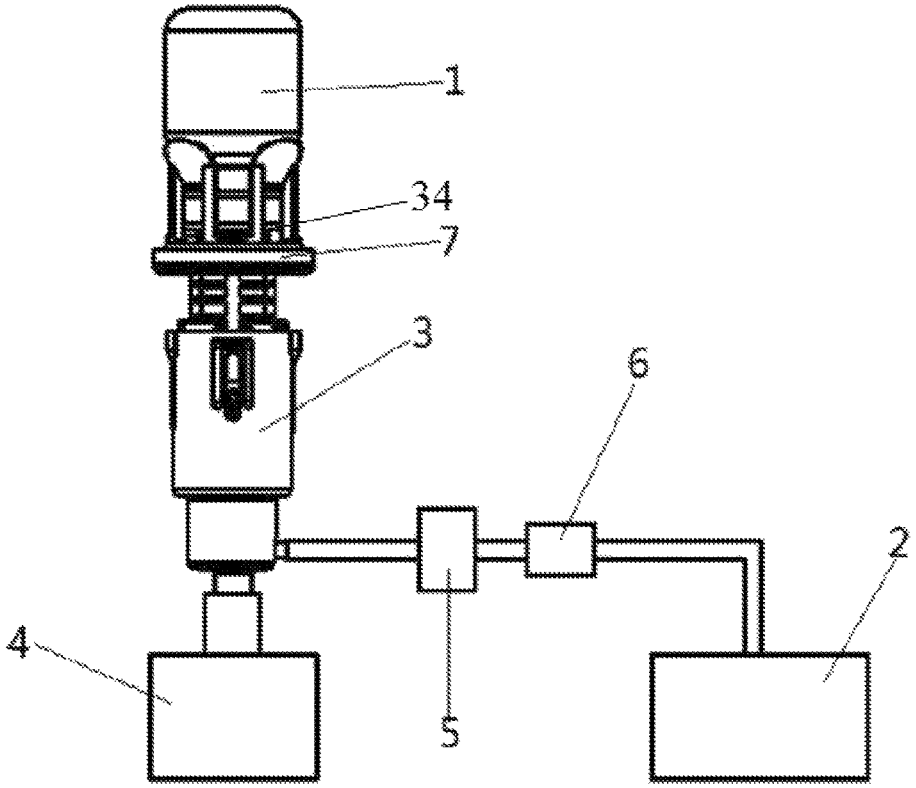
FIG. 1 is an overall structure diagram of a sealed fluid transfer device.

In the drawings, 1: first container; 2: second container; 3: first container puncture adapter; 4: pressure supply unit; 5: second container puncture adapter; 6: second container puncture apparatus; 7: first container puncture apparatus; 8: second protuberance; 9: second concave part; 10: second sealing element; 11: sealing element fixed seat; 12: moving element; 13: upper limit bayonet; 14: lower limit bayonet; 15: first plane; 16: third concave part; 17: guided hole; 18: guided outer casing; 19: limit arm; 20: second plane; 21: limit hole; 22: first concave part; 23: moving element sliding groove; 24: first fluid pipeline; 25: second fluid pipeline; 26: first sealing element; 27: side wall of sealing element fixed seat; 28: guided projection; 29: fourth fluid pipeline; 30: third fluid pipeline; 31: pipeline fixed seat; 32: bottom surface of sealing element fixed seat; 33: bottom surface of guided outer casing; 34: mouth portion of first container; 35: first protuberance; 36: moving element mounting hole; 37: installation hole for pipeline fixed seat.

DETAILED DESCRIPTION OF THE PREFERRED EMBODIMENT

The technical solutions in the embodiments of the present invention will be described clearly and completely hereinafter with reference to the accompanying drawings in the embodiments of the present invention. Apparently, the described embodiments are merely a part but not all embodiments of the present invention. All other embodiments obtained by one skilled in the art based on the embodiments of the present invention without creative efforts shall fall within the protection scope of the present invention.

An object of the present invention is to provide a sealed fluid transfer device and a sealed fluid transfer method both of which are able to achieve the internal conversion of the fluid in a closed environment, so as to solve the above problems in the prior art, so that the internal preparation of the hazardous fluid is able to be completed in a fully enclosed environment, thus avoiding the hazardous fluid in direct contact with air or human body.

To make the foregoing object, features and advantages of the present invention clearer and more comprehensible, the present invention is further described in detail below with reference to the accompanying drawings and specific embodiments.

Figure 2:
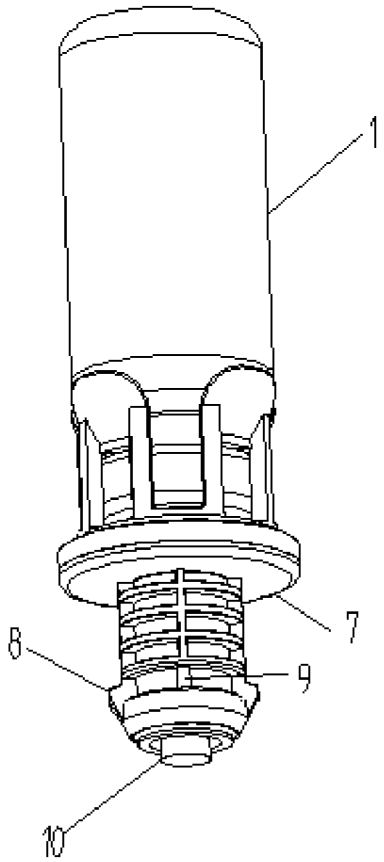
FIG. 2 is an assembly diagram of a first container puncture apparatus and a first container.
Figure 3:
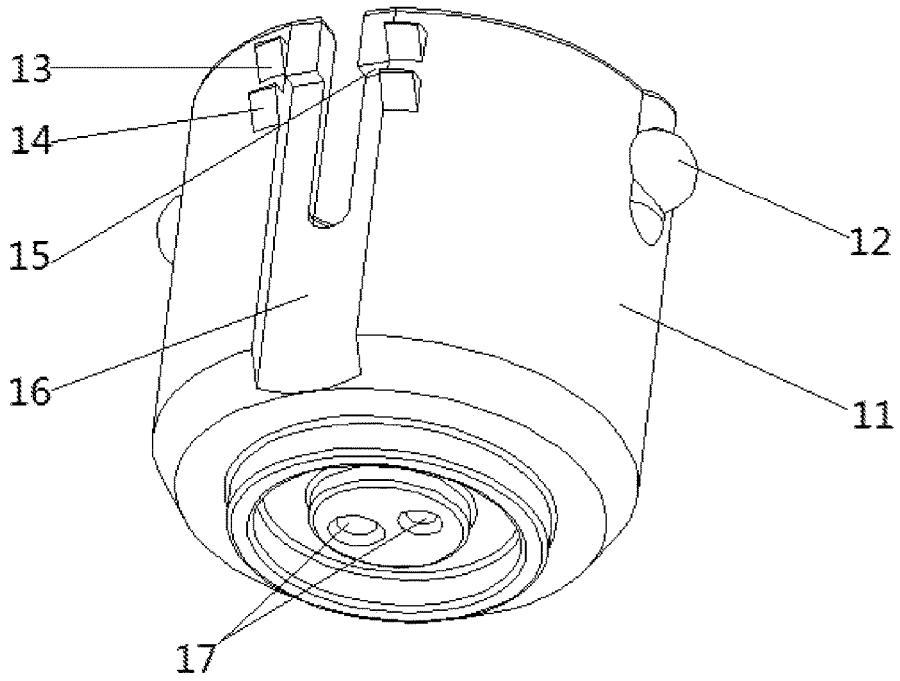
FIG. 3 is an axial structure diagram of a sealing element fixed seat.
Figure 4:
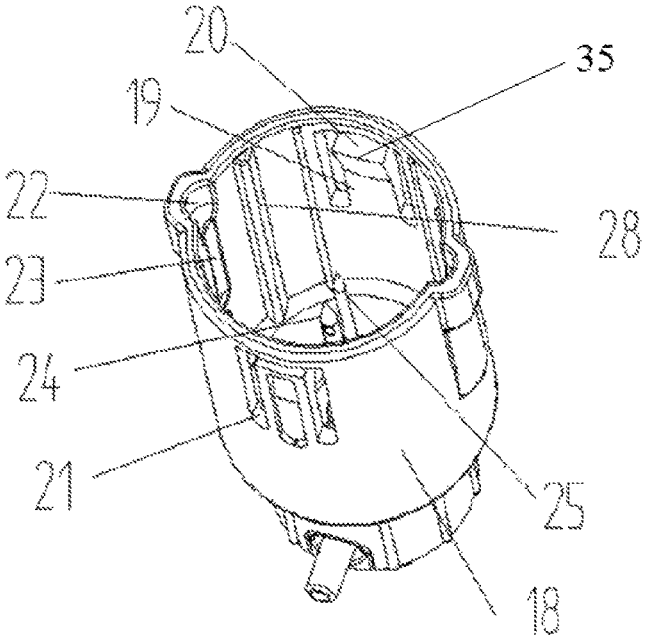
FIG. 4 is an axial structure diagram of a guided outer casing.
Figure 5:
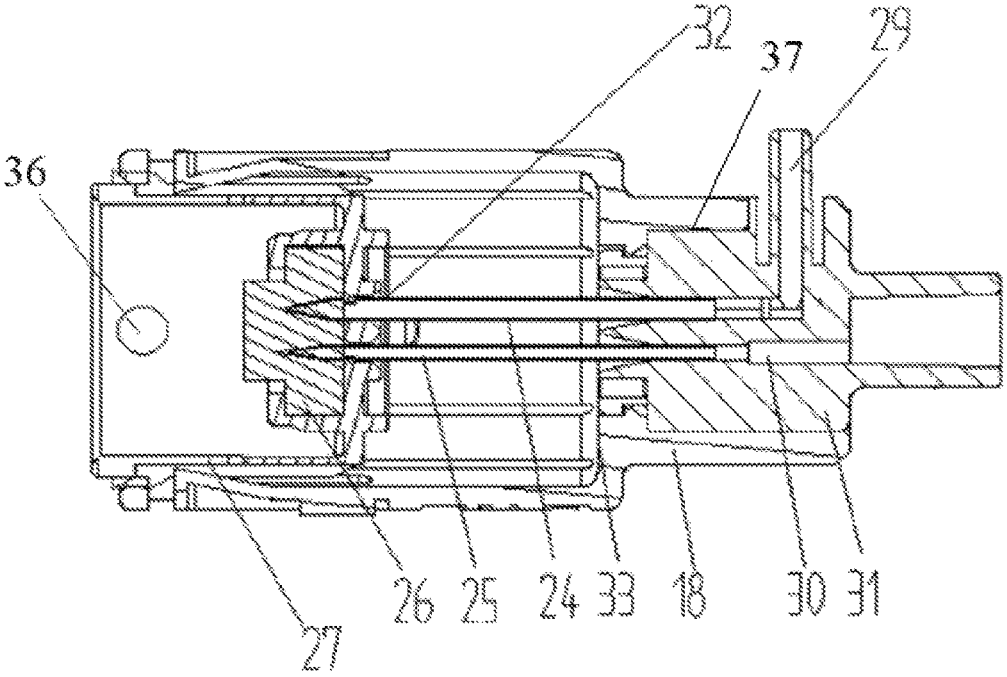
FIG. 5 is a partial section view of a first container puncture adapter.

As shown in FIGS. 1 to 6, a sealed fluid transfer device is illustrated, which comprises a first container puncture apparatus 7, a second container puncture apparatus 6 and a fluid transfer apparatus, wherein the fluid transfer apparatus comprises a first container puncture adapter 3, a second container puncture adapter 5 and a pressure supply unit 4; the first container puncture adapter 3 comprises a sealing element fixed seat 11, a guided outer casing 18, a first fluid pipeline 24 and a second fluid pipeline 25; a first sealing element 26 is installed in the sealing element fixed seat 11; the guided outer casing 18 is located outside the sealing element fixed seat 11; a pipeline fixed seat 31 is located at a lower portion of the guided outer casing 18; both the first fluid pipeline 24 and the second fluid pipeline 25 are located on the pipeline fixed seat 31; a tail portion of the first fluid pipeline 24 is communicated with one end of a third fluid pipeline 30, the other end of the third fluid pipeline 30 is communicated with the pressure supply unit 4; a tail portion of the second fluid pipeline 25 is communicated with the second container puncture adapter 5 through a fourth fluid pipeline 29; the second container puncture adapter 5 is communicated with the second container puncture apparatus 6;

one end of the first container puncture apparatus 7 is located at a mouth portion 34 of a first container 1, a second sealing element 10 is located at the other end of the first container puncture apparatus 7;

when a distance between a bottom surface 32 of the sealing element fixed seat and a bottom surface 33 of the guided outer casing is defined as a first distance, both a fluid outlet of the first fluid pipeline 24 and a fluid outlet of the second fluid pipeline 25 are located outside the first sealing element 26; when the distance between the bottom surface 32 of the sealing element fixed seat and the bottom surface 33 of the guided outer casing is defined as a second distance, both the fluid outlet of the first fluid pipeline 24 and the fluid outlet of the second fluid pipeline 25 are located inside the first sealing element 26; when the distance between the bottom surface 32 of the sealing element fixed seat and the bottom surface 33 of the guided outer casing is defined as a third distance, both the fluid outlet of the first fluid pipeline 24 and the fluid outlet of the second fluid pipeline 25 pass through the second sealing element 10 and then enter the first container puncture apparatus 7; the first container puncture adapter 3 is communicated with the first container puncture apparatus 7.

All of the first distance, the second distance and the third distance are not a single specific value, as long as it is able to be guaranteed that both the fluid outlet of the first fluid pipeline 24 and the fluid outlet of the second fluid pipeline 25 are located outside a lower end of the first sealing element 26 at the first distance; both the fluid outlet of the first fluid pipeline 24 and the fluid outlet of the second fluid pipeline 25 are located inside the first sealing element 26 at the second distance; both the fluid outlet of the first fluid pipeline 24 and the fluid outlet of the second fluid pipeline 25 pass through the second sealing element 10 and then enter the first container puncture apparatus 7 at the third distance; preferably, the third distance is equal to zero, that is, the bottom surface 32 of the sealing element fixed seat is in close fit with the bottom surface 33 of the guided outer casing at the third distance.

When the distance between the bottom surface 32 of the sealing element fixed seat and the bottom surface 33 of the guided outer casing is in a range of the second distance to the third distance, that is, when both the fluid outlet of the first fluid pipeline 24 and the fluid outlet of the second fluid pipeline 25 enter an interior of the second sealing element 10 from an interior of the first sealing element 26, the first sealing element 26 is in close fit with the second sealing element 10, so as to ensure the fluid outlets in a closed state during a process from the interior of the first sealing element 26 to the interior of the second sealing element 10.

After the second container puncture adapter 5 is communicated with the second container puncture apparatus 6, the second container puncture adapter 5 and the second container puncture apparatus 6 form a sealed structure; two sealing elements (which are able to be the third sealed element and the fourth sealed element) are respectively located on the second container puncture adapter 5 and the second container puncture apparatus 6 at a joint of the second container puncture adapter 5 and the second container puncture apparatus 6, so as to ensure a sealing performance of the joint.

Before the sealed fluid transfer device is used, the distance between the bottom surface 32 of the sealing element fixed seat and the bottom surface 33 of the guided outer casing is the first distance; after a product is subjected to a disinfection/sterilization procedure, the distance between the bottom surface 32 of the sealing element fixed seat and the bottom surface 33 of the guided outer casing is the first distance, which facilitates sufficient disinfection/sterilization of the device and aeration of residual disinfection/sterilization media;

after the sealed fluid transfer device is used, due to a limit structure, the distance between the bottom surface 32 of the sealing element fixed seat and the bottom surface 33 of the guided outer casing is only able to be restored to the second distance, that is, both the fluid outlet of the first fluid pipeline 24 and the fluid outlet of the second fluid pipeline 25 are located inside the first sealing element 26, so as to ensure that after the sealed fluid transfer device is used, the residual hazardous fluid at the fluid outlets and inside the fluid pipelines is not exposed to the air or not in direct contact with the human body; and correspondingly, in the sealed fluid transfer device provided by the present invention, an initial state of the distance between the bottom surface 32 of the sealing element fixed seat and the bottom surface 33 of the guided outer casing is that: the distance between the bottom surface 32 of the sealing element fixed seat and the bottom surface 33 of the guided outer casing is the first distance or the second distance.

Preferably, both the fluid outlet of the first fluid pipeline 24 and the fluid outlet of the second fluid pipeline 25 are located outside the pipeline fixed seat 31.

More preferably, an amount of both the fluid outlet of the first fluid pipeline 24 and the fluid outlet of the second fluid pipeline 25 is respectively at least one; both the fluid outlet of the first fluid pipeline 24 and the fluid outlet of the second fluid pipeline 25 are exposed outside an upper surface of the pipeline fixed seat 31; a distance between either the fluid outlet of the first fluid pipeline 24 or the fluid outlet of the second fluid pipeline 25 and the pipeline fixed seat 31 is determined as required, so as to meet the purpose of internal fluid transfer.

Preferably, the sealing element fixed seat 11 has two guided holes 17, both the second fluid pipeline 25 and the first fluid pipeline 24 respectively pass through the guided holes 17 and then enter the sealing element fixed seat.

More preferably, each of the guided holes 17 is a through-hole which is provided in the bottom surface 32 of the sealing element fixed seat; both the second fluid pipeline 25 and the first fluid pipeline 24 respectively pass through the guided holes 17 and then enter the sealing element fixed seat, so as to further enter the first sealing element 26.

Preferably, both a fifth fluid pipeline and a sixth fluid pipeline are located in the first container puncture apparatus 7; one end of both the fifth fluid pipeline and the sixth fluid pipeline extends into the first container, the other end thereof extends to the second sealing element 10.

More preferably, one or more first fluid pipelines 24 and one or more second fluid pipelines 25 pass through the second sealing element 10 and then respectively enter the fifth fluid pipeline and the sixth fluid pipeline, so as to achieve fast and closed fluid movement.

Preferably, the guided outer casing 18 has a limit hole 21 and a limit arm 19; a root portion of the limit arm 19 is fixedly located at a bottom of the limit hole 21 and an end portion of the limit arm 19 is dangling; a first protuberance 35 is located at an inner side of the end portion of the limit arm 19, a second protuberance 8 is located at a terminal of the first container puncture apparatus 7, the terminal of the first container puncture apparatus 7 is able to extend into the sealing element fixed seat 11, the first protuberance 35 contacts with the second protuberance 8, and the second protuberance 8 presses the first protuberance 35 towards an external side of the guided outer casing.

A positional relationship of the second protuberance 8 relative to the second sealing element 10 is as follows. The second protuberance 8 is located above the second sealing element 10 and is closer to the mouth portion 34 of the first container 1 than the second sealing member 10; the limit arm 19 is an elastic limit arm.

Preferably, the sealing element fixed seat comprises a bottom surface 32 of the sealing element fixed seat and a side wall 27 thereof, wherein a third concave part 16, which matches with the first protuberance 35, is provided on the side wall 27 of the sealing element fixed seat; the third concave part 16 has a first plane 15 facing towards a bottom on the side wall 27 of the sealing element fixed seat; the first protuberance 35 has a second plane 20 opposite to the first plane 15; when the first protuberance 35 is not pressed towards the external side of the guided outer casing, a projection of the first plane 15 and a projection of the second plane 20 have overlapping regions.

When the first protuberance 35 is not pressed towards the external side of the guided outer casing, the projection of the first plane 15 and the projection of the second plane 20 have overlapping regions, so as to ensure that the sealing element fixed seat 11 is unable to move smoothly in the guided outer casing 18 when the first protuberance 35 is not pressed towards the external side of the guided outer casing; when the first protuberance 35 is pressed towards the external side of the guided outer casing, the projection of the first plane 15 and the projection of the second plane 20 do not have an overlapping region, so as to ensure that the sealing element fixed seat 11 is able to move smoothly in the guided outer casing 18.

Preferably, multiple guided projections 28 are located at an inner wall of the guided outer casing; multiple guided grooves, which are respectively corresponding to the guided projections 28, are provided on the side wall 27 of the sealing element fixed seat.

Preferably, the pressure supply unit 4 is adapted for providing a required positive or negative pressure during an operation of the sealed fluid transfer device.

The pressure supply unit 4 has strong sealing performance to well store gases absorbed by the pressure supply unit 4 for forming strong pressure, so that while providing the required positive or negative pressure, it is ensured that the dangerous fluid is unable to enter the pressure supply unit 4.

Preferably, an upper limit bayonet 13 and a lower limit bayonet 14 are located on the side wall 27 of the sealing element fixed seat.

More preferably, both the upper limit bayonet 13 and the lower limit bayonet 14 on the side wall 27 of the sealing element fixed seat are adapted for limiting the sealing element fixed seat, and correspondingly, both the upper limit bayonet 13 and the lower limit bayonet 14 on the side wall 27 of the sealing element fixed seat are also able to be provided on a side wall of the guided outer casing 18, and limit recesses, which are respectively corresponding to the upper limit bayonet 13 and the lower limit bayonet 14, are provided on the side wall 27 of the sealing element fixed seat.

Preferably, when the distance between the bottom surface 32 of the sealing element fixed seat and the bottom surface 33 of the guided outer casing is defined as the first distance, the upper limit bayonet 13 and the lower limit bayonet 14 respectively contact with an upper end surface of the guided outer casing and an upper end surface of the limit hole 21, so as to respectively limit the sealing element fixed seat to move upwardly and downwardly relatively to the guided outer casing.

Preferably, when the distance between the bottom surface 32 of the sealing element fixed seat and the bottom surface 33 of the guided outer casing is defined as the second distance, the upper limit bayonet 13 contacts with an upper end surface of the limit hole 21, both the fluid outlet of the first fluid pipeline 24 and the fluid outlet of the second fluid pipeline 25 are located inside the first sealing element.

Preferably, the guided outer casing has a first concave part 22, the side wall 27 of the sealing element fixed seat has a moving element mounting hole 36, a moving element 12 is located in the moving element mounting hole 36, the other end of the first container puncture apparatus 7 comprises a second concave part 9.

A radial angle of the moving element mounting hole 36 on the side wall 27 of the sealing element fixed seat is consistent with a radial angle of the first concave part 22 on the guided outer casing.

Preferably, a moving element sliding groove 23 is located below the first concave part 22.

Preferably, when the distance between the bottom surface 32 of the sealing element fixed seat and the bottom surface 33 of the guided outer casing is defined as the third distance, the moving element 12 locks the first container puncture apparatus 7.

Preferably, an amount of the second fluid pipeline 15 is at least one, and an amount of the first fluid pipeline 24 is at least one.

Preferably, the guided outer casing has an installation hole 37 for the pipeline fixed seat 31 at the lower portion of the guided outer casing, or the guided outer casing and the pipeline fixed seat 31 are integrally formed.

Preferably, both the first fluid pipeline 24 and the second fluid pipeline 25 are installed to the pipeline fixed seat 31, or the first fluid pipeline 24, the second fluid pipeline 25 and the pipeline fixed seat 31 are integrally formed.

The present invention also provides a sealed fluid transfer method of the above-mentioned sealed fluid transfer device, which comprises steps of:

connecting a first container with a first container puncture adapter of a fluid transfer apparatus through a first container puncture apparatus 7; connecting a second container with a second container puncture adapter of the fluid transfer apparatus through a second container puncture apparatus 6; connecting the first container puncture adapter with the second container puncture adapter through conduits; and connecting the first container puncture adapter with a pressure supply unit 4; wherein:

when the first container is filled with liquid, the liquid in the first container is away from a mouth position of the first container under the effect of gravity, and meanwhile, the liquid in the second container is away from a mouth position of the second container under the effect of gravity; at this time, the pressure supply unit 4 provides a negative pressure, gas in the second container is transferred into the first container through the second container puncture apparatus 6, the fluid transfer apparatus and the first container puncture apparatus 7, and meanwhile, gas in the first container enters the pressure supply unit, the liquid in the second container enter the first container under an action of the negative pressure to form a mixed solution; at this time, the first container is inverted to move the mixed solution in the first container to the mouth position of the first container under the effect of gravity, the pressure supply unit 4 provides a positive pressure, so that the mixed solution in the first container passes through the first container puncture apparatus 7, the fluid transfer apparatus and the second container puncture apparatus 6 and reaches the second container, thus achieving sealed liquid transfer;

when the first container contains solid powders, the solid powders in the first container are away from the mouth position of the first container under the effect of gravity, and meanwhile, the liquid in the second container is away from the mouth position of the second container under the effect of gravity; at this time, the pressure supply unit 4 provides the negative pressure, the gas in the first container enters the pressure supply unit 4, the liquid in the second container enters the first container under the action of the negative pressure; at this time, the first container is rocked to mix the powders in the first container with the liquid, the first container is inverted to move the mixed solution in the first container to the mouth position of the first container, the pressure supply unit 4 provides the positive pressure under the effect of gravity, so that the mixed solution in the first container passes through the first container puncture apparatus 7, the fluid transfer apparatus and the second container puncture apparatus 6 and reaches the second container, thus achieving sealed liquid transfer.

What is claimed is:

1. A sealed fluid transfer device, which comprises a first container puncture apparatus, a second container puncture apparatus and a fluid transfer apparatus, wherein the fluid transfer apparatus comprises a first container puncture adapter, a second container puncture adapter and a pressure supply unit; the first container puncture adapter comprises a sealing element fixed seat, a guided outer casing, a first fluid pipeline and a second fluid pipeline; a first sealing element is installed in the sealing element fixed seat; the guided outer casing is located outside the sealing element fixed seat; a pipeline fixed seat is located at a lower portion of the guided outer casing; both the first fluid pipeline and the second fluid pipeline are located on the pipeline fixed seat; a tail portion of the first fluid pipeline is communicated with one end of a third fluid pipeline, the other end of the third fluid pipeline is communicated with the pressure supply unit; a tail portion of the second fluid pipeline is communicated with the second container puncture adapter through a fourth fluid pipeline; the second container puncture adapter is communicated with the second container puncture apparatus;

one end of the first container puncture apparatus is located at a mouth portion of a first container, a second sealing element is located at the other end of the first container puncture apparatus;

when a distance between a bottom surface of the sealing element fixed seat and a bottom surface of the guided outer casing is defined as a first distance, both a fluid outlet of the first fluid pipeline and a fluid outlet of the second fluid pipeline are located outside the first sealing element; when the distance between the bottom surface of the sealing element fixed seat and the bottom surface of the guided outer casing is defined as a second distance, both the fluid outlet of the first fluid pipeline and the fluid outlet of the second fluid pipeline are located inside the first sealing element; when the distance between the bottom surface of the sealing element fixed seat and the bottom surface of the guided outer casing is defined as a third distance, both the fluid outlet of the first fluid pipeline and the fluid outlet of the second fluid pipeline pass through the second sealing element and then enter the first container puncture apparatus; the first container puncture adapter is communicated with the first container puncture apparatus.

2. The sealed fluid transfer device, as recited in claim 1, wherein both the fluid outlet of the first fluid pipeline and the fluid outlet of the second fluid pipeline are exposed outside the pipeline fixed seat.

3. The sealed fluid transfer device, as recited in claim 1, wherein the sealing element fixed seat has a guided hole, both the second fluid pipeline and the first fluid pipeline pass through the guided hole and then enter the sealing element fixed seat.

4. The sealed fluid transfer device, as recited in claim 1, wherein both a fifth fluid pipeline and a sixth fluid pipeline are located in the first container puncture apparatus; one end of both the fifth fluid pipeline and the sixth fluid pipeline extends into the first container, the other end thereof extends to the second sealing element.

5. The sealed fluid transfer device, as recited in claim 1, wherein the guided outer casing has a limit hole and a limit arm; a root portion of the limit arm is fixedly located at a bottom of the limit hole and an end portion of the limit arm is dangling; a first protuberance is located at an inner side of the end portion of the limit arm, a second protuberance is located at a terminal of the first container puncture apparatus, the terminal of the first container puncture apparatus extends into the sealing element fixed seat, the first protuberance contacts with the second protuberance, and the second protuberance presses the first protuberance towards an external side of the guided outer casing.

6. The sealed fluid transfer device, as recited in claim 5, wherein the sealing element fixed seat comprises the bottom surface of the sealing element fixed seat and a side wall thereof, wherein a third concave part, which matches with the first protuberance, is provided on the side wall of the sealing element fixed seat; the third concave part has a first plane facing towards a bottom on the side wall of the sealing element fixed seat; the first protuberance has a second plane opposite to the first plane; when the first protuberance is not pressed towards the external side of the guided outer casing, a projection of the first plane and a projection of the second plane have overlapping regions.

7. The sealed fluid transfer device, as recited in claim 1, wherein the pressure supply unit is adapted for providing a required positive or negative pressure during an operation of the sealed fluid transfer device.

8. The sealed fluid transfer device, as recited in claim 6, wherein an upper limit bayonet and a lower limit bayonet are located on the side wall of the sealing element fixed seat.

9. The sealed fluid transfer device, as recited in claim 8, wherein when the distance between the bottom surface of the sealing element fixed seat and the bottom surface of the guided outer casing is defined as the first distance, the upper limit bayonet and the lower limit bayonet respectively contact with an upper end surface of the guided outer casing and an upper end surface of the limit hole, so as to respectively limit the sealing element fixed seat to move upwardly and downwardly relatively to the guided outer casing.

10. The sealed fluid transfer device, as recited in claim 8, wherein when the distance between the bottom surface of the sealing element fixed seat and the bottom surface of the guided outer casing is defined as the second distance, the upper limit bayonet contacts with an upper end surface of the limit hole, both the fluid outlet of the first fluid pipeline and the fluid outlet of the second fluid pipeline are located inside the first sealing element.

11. The sealed fluid transfer device, as recited in claim 6, wherein the guided outer casing comprises a first concave part, the side wall of the sealing element fixed seat has a moving element mounting hole, a moving element is located in the moving element mounting hole, the other end of the first container puncture apparatus comprises a second concave part.

12. The sealed fluid transfer device, as recited in claim 11, wherein a moving element sliding groove is located below the first concave part.

13. The sealed fluid transfer device, as recited in claim 11, wherein when the distance between the bottom surface of the sealing element fixed seat and the bottom surface of the guided outer casing is defined as the third distance, the moving element locks the first container puncture apparatus.

14. The sealed fluid transfer device, as recited in claim 1, wherein an amount of the second fluid pipeline is at least one, and an amount of the first fluid pipeline is at least one.

15. The sealed fluid transfer device, as recited in claim 1, wherein the guided outer casing has an installation hole for the pipeline fixed seat at the lower portion of the guided outer casing, or the guided outer casing and the pipeline fixed seat are integrally formed.

16. The sealed fluid transfer device, as recited in claim 15, wherein both the first fluid pipeline and the second fluid pipeline are installed to the pipeline fixed seat, or the first fluid pipeline, the second fluid pipeline and the pipeline fixed seat are integrally formed.

17. A sealed fluid transfer method, which comprises steps of: connecting a first container with a first container puncture adapter of a fluid transfer apparatus through a first container puncture apparatus; connecting a second container with a second container puncture adapter of the fluid transfer apparatus through a second container puncture apparatus; connecting the first container puncture adapter with the second container puncture adapter through conduits; and connecting the first container puncture adapter with a pressure supply unit; wherein:

when the first container is filled with liquid, the liquid in the first container is away from a mouth position of the first container under the effect of gravity, and meanwhile, the liquid in the second container is away from a mouth position of the second container under the effect of gravity; at this time, the pressure supply unit provides a negative pressure, gas in the second container is transferred into the first container through the second container puncture apparatus, the fluid transfer apparatus and the first container puncture apparatus, and meanwhile, gas in the first container enters the pressure supply unit, the liquid in the second container enter the first container under an action of the negative pressure to form a mixed solution; at this time, the first container is inverted to move the mixed solution in the first container to the mouth position of the first container under the effect of gravity, the pressure supply unit provides a positive pressure, so that the mixed solution in the first container passes through the first container puncture apparatus, the fluid transfer apparatus and the second container puncture apparatus and reaches the second container, thus achieving sealed liquid transfer;

when the first container contains solid powders, the solid powders in the first container are away from the mouth position of the first container under the effect of gravity, and meanwhile, the liquid in the second container is away from the mouth position of the second container under the effect of gravity; at this time, the pressure supply unit provides the negative pressure, the gas in the first container enters the pressure supply unit, the liquid in the second container enters the first container under the action of the negative pressure; at this time, the first container is rocked to mix the powders in the first container with the liquid, the first container is inverted to move the mixed solution in the first container to the mouth position of the first container under the effect of gravity, the pressure supply unit provides the positive pressure, so that the mixed solution in the first container passes through the first container puncture apparatus, the fluid transfer apparatus and the second container puncture apparatus and reaches the second container, thus achieving sealed liquid transfer.

* * * * *